US007946735B2

(12) United States Patent
Chou et al.

(10) Patent No.: US 7,946,735 B2
(45) Date of Patent: May 24, 2011

(54) LED LIGHTING APPARATUS HAVING HEAT DISSIPATING FRAME

(76) Inventors: Joseph Chou, Temple City, CA (US); Neng-Tze Yang, Hermosa Beach, CA (US)

( * ) Notice: Subject to any disclaimer, the term of this patent is extended or adjusted under 35 U.S.C. 154(b) by 158 days.

(21) Appl. No.: 12/229,458

(22) Filed: Aug. 22, 2008

(65) Prior Publication Data

US 2010/0046233 A1 Feb. 25, 2010

(51) Int. Cl.
*F21V 7/20* (2006.01)
*F21V 7/04* (2006.01)
*F21V 29/00* (2006.01)

(52) U.S. Cl. ..... 362/345; 362/294; 362/296.05; 362/341

(58) Field of Classification Search ..... 362/345, 362/296.05, 294, 346, 298, 341, 545, 547, 362/241–248, 249.02, 311.02, 296.01, 297, 362/310, 296.07–296.08, 373, 800; 2/345, 2/296.05, 294, 346, 298, 341, 545, 547, 241–248, 2/249.02, 311.02, 296.01, 297, 310, 296.07–296.08, 2/373

See application file for complete search history.

(56) References Cited

U.S. PATENT DOCUMENTS 5,490,049 A * 2/1996 Montalan et al. ..... 362/241
5,580,156 A * 12/1996 Suzuki et al. ..... 362/297
6,578,998 B2 * 6/2003 Zhang ..... 362/555
6,644,841 B2 * 11/2003 Martineau ..... 362/545
6,966,677 B2 * 11/2005 Galli ..... 362/373
7,422,349 B2 * 9/2008 Wada et al. ..... 362/373
7,677,765 B2 * 3/2010 Tajul et al. ..... 362/294
2005/0162854 A1 * 7/2005 Finch ..... 362/304
2005/0168994 A1 * 8/2005 Jacobson et al. ..... 362/311
2007/0189017 A1 * 8/2007 Hofmann ..... 362/345
2007/0279910 A1 * 12/2007 Lin ..... 362/298
2008/0094835 A1 * 4/2008 Marra et al. ..... 362/373
2008/0192477 A1 * 8/2008 Holder et al. ..... 362/294
2009/0290349 A1 * 11/2009 Chu et al. ..... 362/249.02

* cited by examiner

*Primary Examiner* — Alan Cariaso

(74) *Attorney, Agent, or Firm* — Raymond Y. Chan; David and Raymond Patent Firm

(57) ABSTRACT

A LED light apparatus includes a conical reflection housing and a LED light source. The reflection housing has a vertex, a light opening aligning with the vertex, an inner flat reflection surface. The LED light source includes a light head alignedly pointing towards the vertex, wherein when the light head generates light a first portion of the light is accumulatively reflected by the reflection surface towards the light opening while a second portion of the light is projected towards the non-reflection arrangement to prevent the second portion of the light being reflected back to the light source for minimizing a black spot occurring at the light opening. Accordingly, the wide light pattern is refocused into a narrow beam pattern to improve the lighting efficiency. The distribution of the light output is regulated, and the heat generation is reduced.

13 Claims, 11 Drawing Sheets

LED LIGHTING APPARATUS HAVING HEAT DISSIPATING FRAME

BACKGROUND OF THE PRESENT INVENTION

1. Field of Invention

The present invention relates to an LED lighting apparatus, and more particularly to an apparatus which concentrates the projection of an LED light source by a linear reflective surface.

2. Description of Related Arts

LED lightings are widely used these days for its numerous benefits such as energy saving, small size, long life, and durability. However, currently the overall light output of LED is still relatively low, extra apparatus are needed to concentrate the light output for increasing the intension.

LED is a solid state semiconductor device. It directly produces visible light when the semiconductor crystal is excited. It can be regarded as a small area light source and project light radially. Generally the semiconductor crystal is packed in a transparent package to shape its light beam patterns. The light beam patterns are typically within 90 to 120 degree angles. For a standard 90 degree LED, the relative luminous intensity is illustrated in FIG. 6. Referring to FIG. 6, the intensity is the highest at zero degree angle and drops to 50% at +/−45 degree. The light spread in a large angle of range. The relative luminous flux is about peaked within the 30 to 40 degree range.

Most of existing LED lightings is more or less following the output beam patterns. As mentioned above, this performance is not efficient, and wastes a lot of energy. If not sufficient brightness can be provided, LED with higher power is needed. Obviously this will cost more, and generate more heat. One solution is using single reflection curved surface to focus the LED light for the desired light patterns. For example, the reflection curved surface is parabolic. The LED light source is location on the focal point of the paraboloid and projecting light onto the reflection curved surface. The light rays are reflected once by the surface to form a parallel beam. This will concentrate the light in a limited area (spot). But the curved reflection surface still has a problem. Since the light ray with the zero degree will be reflected in the same path, and will be blocked by the LED itself, at the same time all other light rays are reflected in parallel, a black spot is formed in the center of the light beam. It needs to be avoid because most of the time the center of the light beam should have the highest brightness.

SUMMARY OF THE PRESENT INVENTION

The main object of the present invention is to provide a LED light apparatus to increase the LED light output efficiency and to minimize a black spot during light reflection.

Another object of the present invention is to provide a LED light apparatus to increase the brightness.

Another object of the present invention is to provide a LED light apparatus to focus the light beam of the LED light output.

Another object of the present invention is to provide a LED light apparatus to regulate the light beam patterns of the LED.

Another object of the present invention is to provide a LED light apparatus to regulate the distribution of the LED light output.

Another object of the present invention is to provide a LED light apparatus which is easy to fabricate.

Another object of the present invention is to provide a LED light apparatus to release heat efficiently.

Accordingly, in order to accomplish the above objects, the present invention provides a LED light apparatus comprising a conical reflection housing and a LED light source.

The reflection housing has a vertex, a light opening aligning with the vertex, and an inner flat reflection surface extending from the vertex towards the light opening. The reflection housing further comprises a non-reflection arrangement provided at the vertex.

The LED light source comprises a light body coaxially supported within the reflection housing and a light head alignedly pointing towards the vertex, wherein when the light head generates light towards the reflection surface of the reflection housing, a first portion of the light is accumulatively reflected by the reflection surface of the reflection towards the light opening while a second portion of the light is projected towards the non-reflection arrangement so as to prevent the second portion of the light being reflected back to the light source for minimizing a black spot occurring at the light opening.

These and other objectives, features, and advantages of the present invention will become apparent from the following detailed description, the accompanying drawings, and the appended claims.

DETAILED DESCRIPTION OF THE PREFERRED EMBODIMENT

Figure 1:
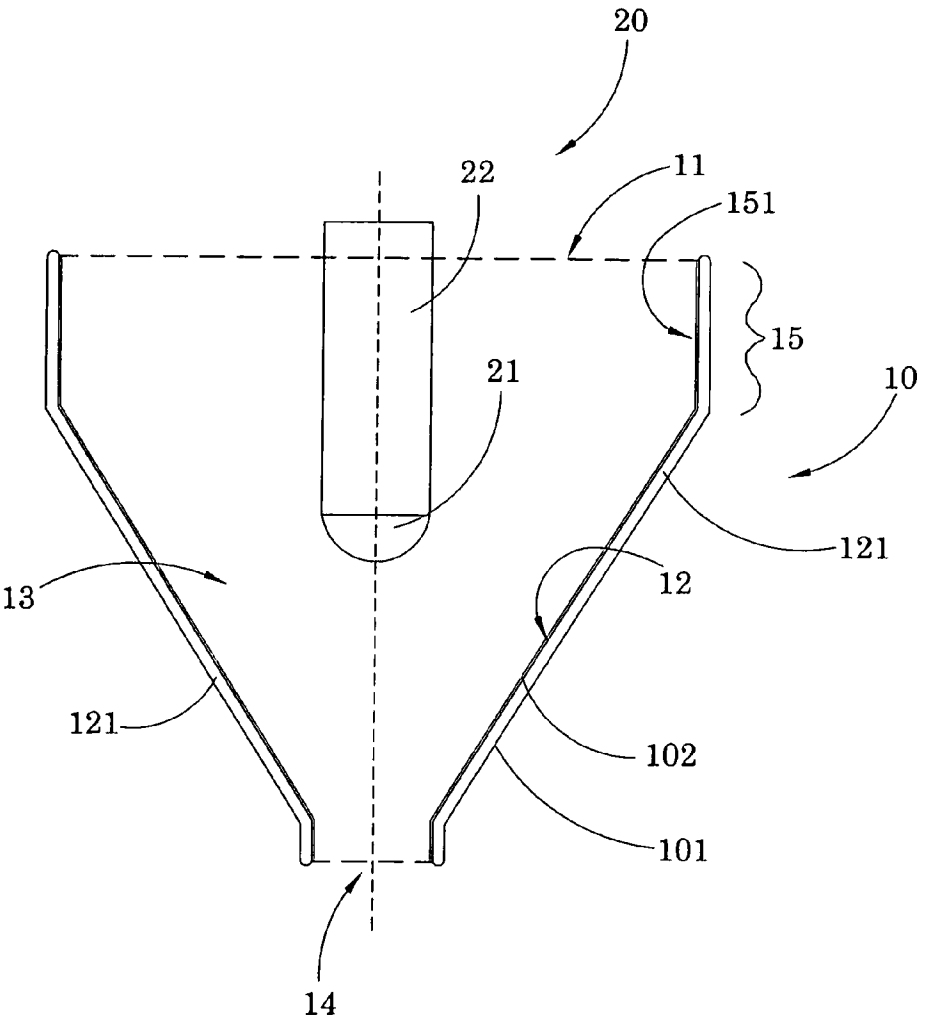
FIG. 1 illustrates a typical dimension of a LED lighting apparatus according to a preferred embodiment of the present invention.

Referring to FIGS. 1 to 5 of the drawings of the present invention, the LED lighting apparatus according to a preferred embodiment of the present invention is illustrated, wherein the LED lighting apparatus comprises a reflection housing 10 and a light source 20.

The reflection housing 10 is in a right circular cone shape which has a vertex and a light opening 11. The reflection housing 10 also has a taper reflection surface 12 at the inner face which is extended from the vertex to the light opening 11. The reflection housing 10 comprises a cone shaped reflection body 101 and a reflection layer 102 coated at an inner surface of the reflection body 101 to form the inner reflection surface 12 of the reflection housing 10.

The reflection housing 10 further comprises a non-reflection arrangement provided at the vertex. Accordingly, the reflection housing 10 has an isosceles triangular cross section that two sidewalls of the reflection housing 10 are in equal length.

The light source 20 is supported in the reflection housing 10 for projecting light towards the reflection surface 12. The light source 20 comprises a light body 22 and a light head 21 supported at the light body 22. Accordingly, the light head 21 comprises a LED supported at the light body 22 to generate light within the reflection housing 10.

Figure 8:
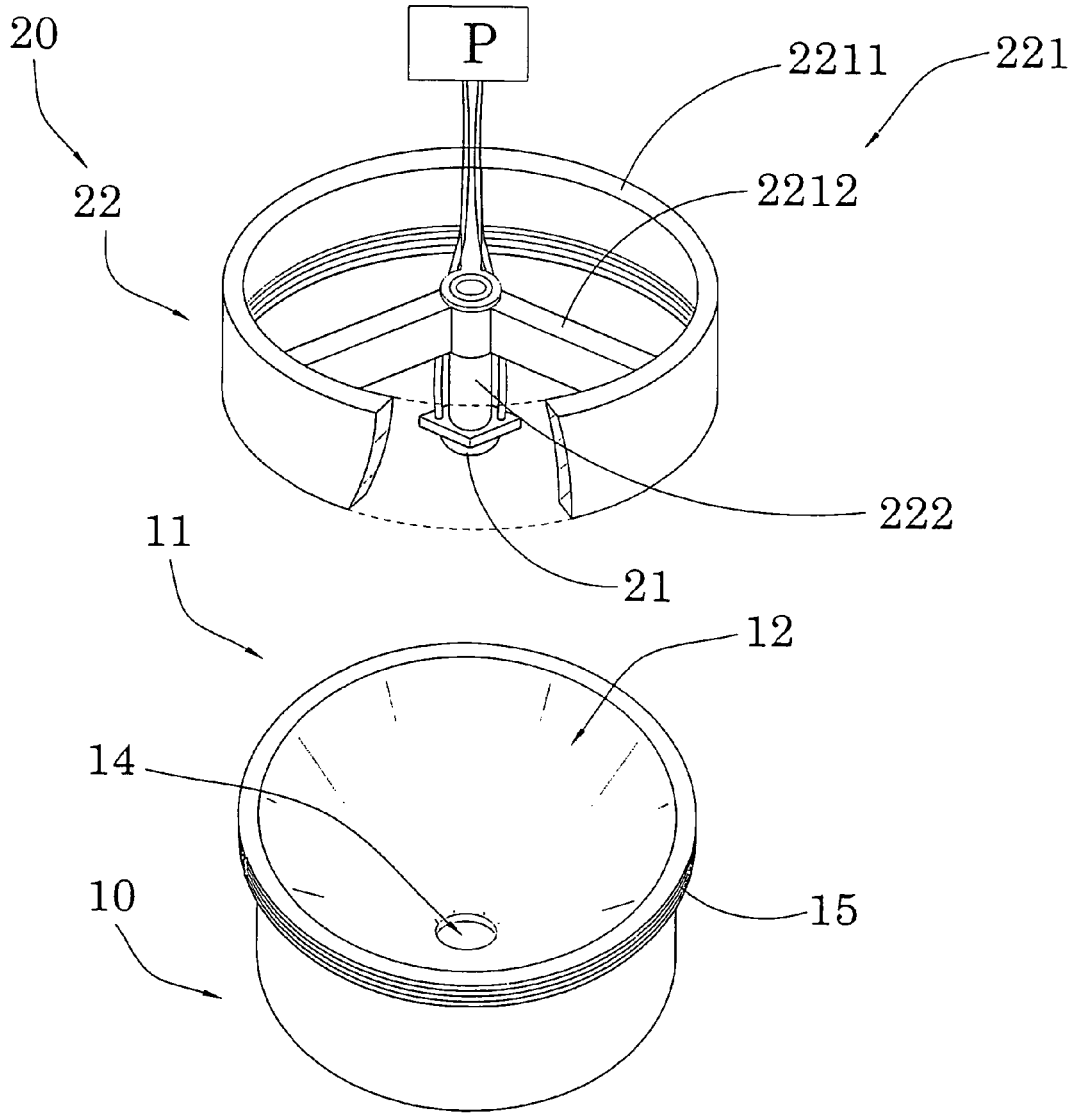
FIG. 8 illustrates the LED lighting apparatus as a spotlight according to the above preferred embodiment of the present invention.

When the light head 21 generates light towards the reflection surface 12 of the reflection housing 10, a first portion of the light is accumulatively reflected by the reflection surface 21 of the reflection housing 10 towards the light opening 11 while a second portion of the light is projected towards the non-reflection arrangement so as to prevent the second portion of the light being reflected back to the light source 20 for minimizing a black spot occurring at the light opening 11. Therefore, the LED lighting apparatus of the present invention forms a spot light that the light projected out of the light opening 11 is focused within a desired area, as shown in FIG. 8.

It is worth to mention that the first portion of the light ray from the light source 20 is reflected once or multiple times by the reflection surface 12 and finally out of the reflection house 10 from the light opening 11 thereof.

In a preferred embodiment of the present invention, the reflection surface 12 defines a space 13 which is in a cone shape. Referring to FIGS. 2 to 5, the reflection surface 12 has a linear wall 121 which is leaning from the light opening 11 to the vertex of the cone with an inclining angle $\theta_1$. The inclining angle is the angle between the vertical axis of the reflection housing 10 and the linear line on the wall of the reflection surface 12. It is also the half-angle of the cone. The inclining angle varies in different embodiments. In other words, the reflection surface 12, having a linear slope and defining the inclination angle, extends from the vertex of the reflection housing 10 to the light opening 11 for enabling the first portion of the light being multi-reflected within the reflection housing 10.

The LED light source 20 is supported on the vertical axis of the reflection housing 10 symmetrically. The vertical axis of the LED light source 20 and the vertical axis of the reflection housing 10 are overlapped. When the LED is illuminating light, the light ray has a projection angle with the vertical axis. For the standard 90 degree LED, the maximum projection angle $\theta_2$ is 45 degree. For the standard 120 degree LED, the maximum projection angle $\theta_2$ is 60 degree. When the LED light is projected onto the reflection surface 12, it will be reflected.

Depending on the value of the inclining angle and the projection angle, the light ray will be reflected to the opposite wall of the reflection surface 12, and be reflected again. This is multiple-reflection mode. If the light ray is reflected twice before output, it is double-reflection mode. If the light ray is reflected three times before output, it is triple-reflection mode. If the light ray is reflected four times before output, it is quadruple-reflection mode. Otherwise, the light ray will be reflected directly out of the reflection housing 10 through the light opening 11, and this is single-reflection mode.

Figure 2:
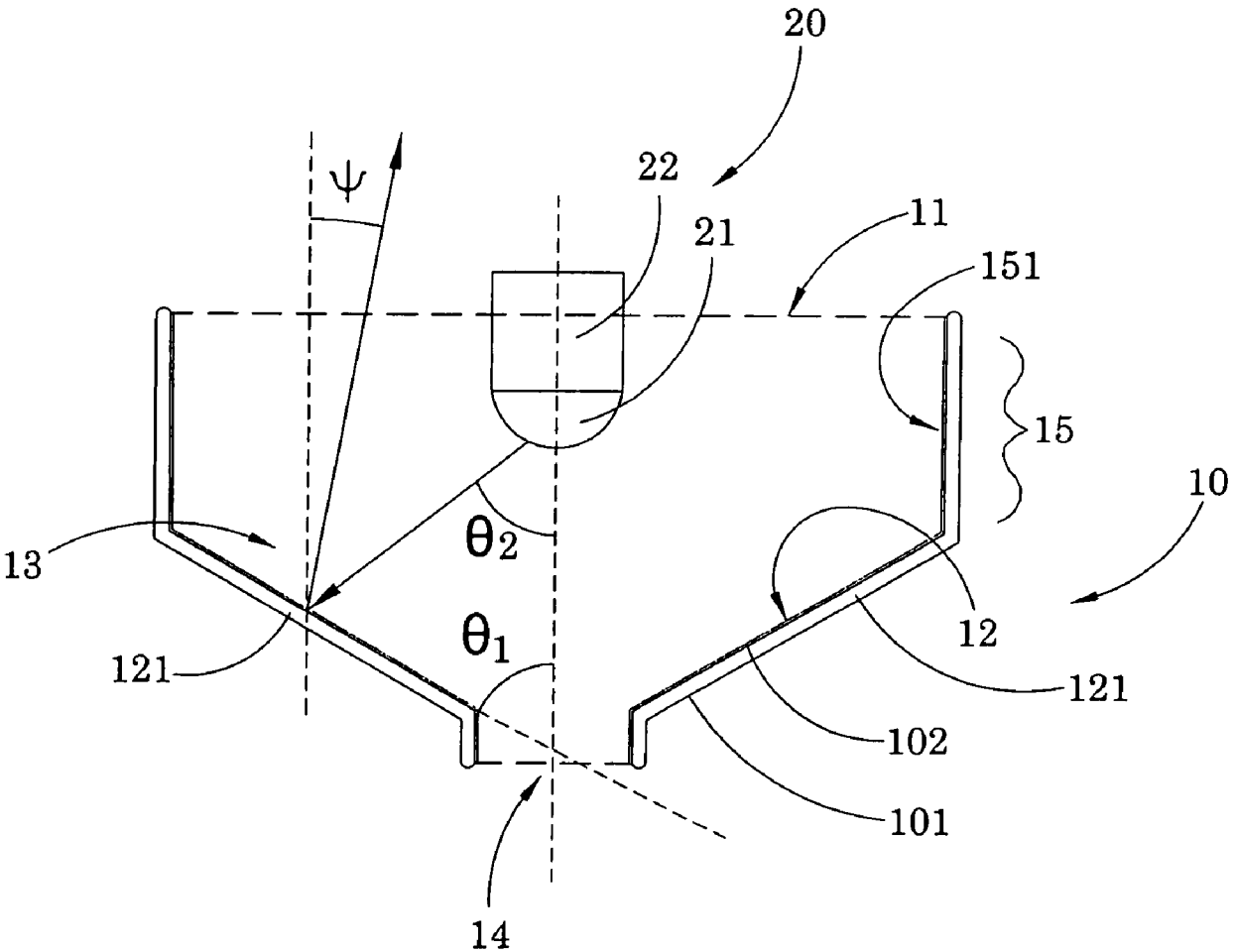
FIG. 2 is a schematic view of the LED lighting apparatus according to the above preferred embodiment of the present invention, illustrating the LED lighting apparatus working in single-reflection mode.

When the light ray is reflected out of the reflection housing 10, it has an output angle with the vertical axis. The maximum output angle $\psi$ represents the output beam angle of the LED. Referring to FIG. 2, in single-reflection mode, the relationship of these angles is:

$$\Psi=180-2\theta_1-\theta_2$$

When the $\theta_2$ is about 45 degree, the output of the LED will be converted to a narrow angle beam, which is about 10 degree.

Figure 3:
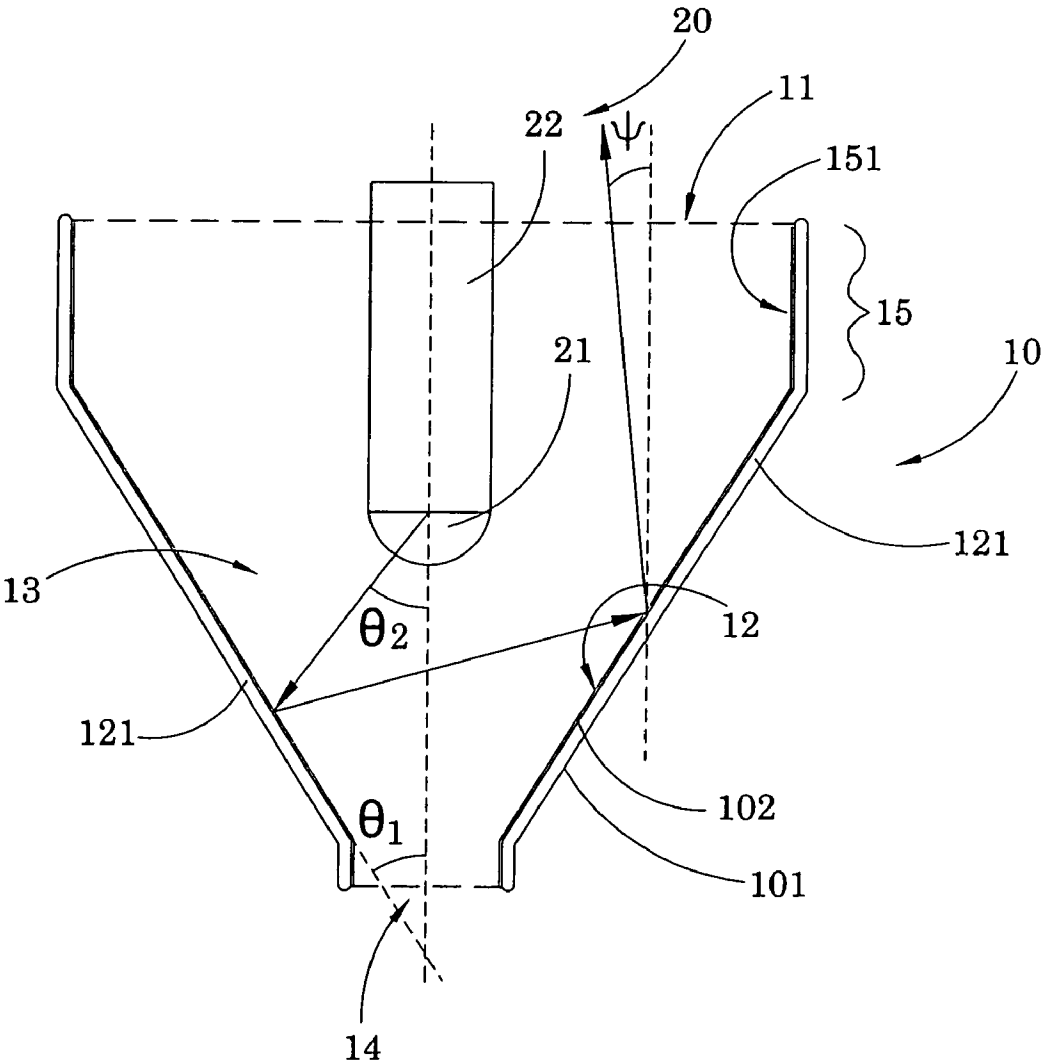
FIG. 3 is a schematic view of the LED lighting apparatus according to the above preferred embodiment of the present invention, illustrating the LED lighting apparatus working in double-reflection mode.

Referring to FIG. 3, in the double-reflection mode, the relationship of the angles is:

$$\Psi=180-4\theta_1-\theta_2$$

When the $\theta_2$ is about 40 degree, the output of the LED will be converted to a narrow angle beam, which is about −5 degree.

Figure 4:
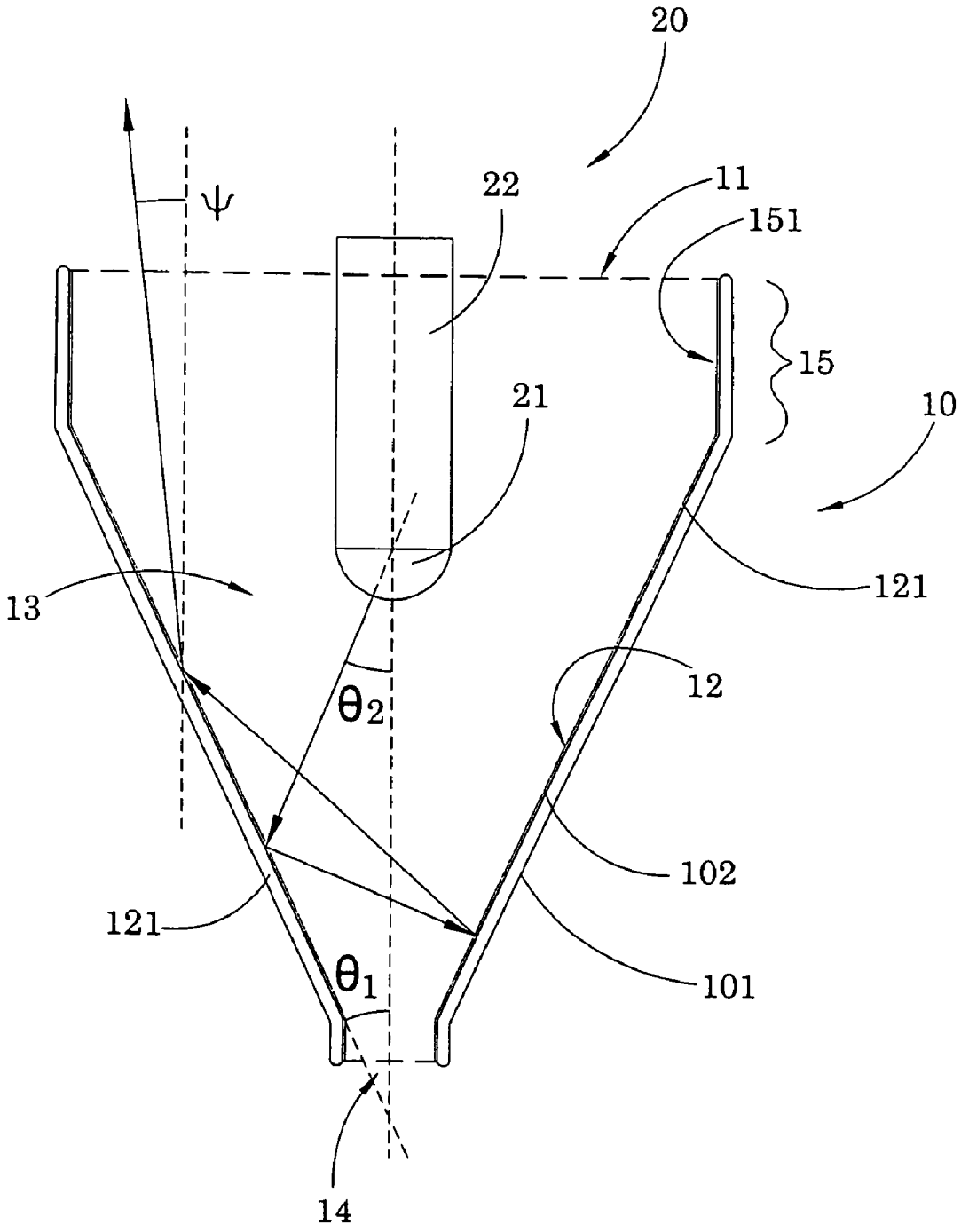
FIG. 4 is a schematic view of the LED lighting apparatus according to the above preferred embodiment of the present invention, illustrating the LED lighting apparatus working in triple-reflection mode.

Referring to FIG. 4, in the triple-reflection mode, the relationship of the angles is:

$$\Psi=180-6\theta_1-\theta_2$$

When the $\theta_2$ is about 40 degree, the output of the LED will be converted to a narrow angle beam, which is about −10 degree.

Figure 5:
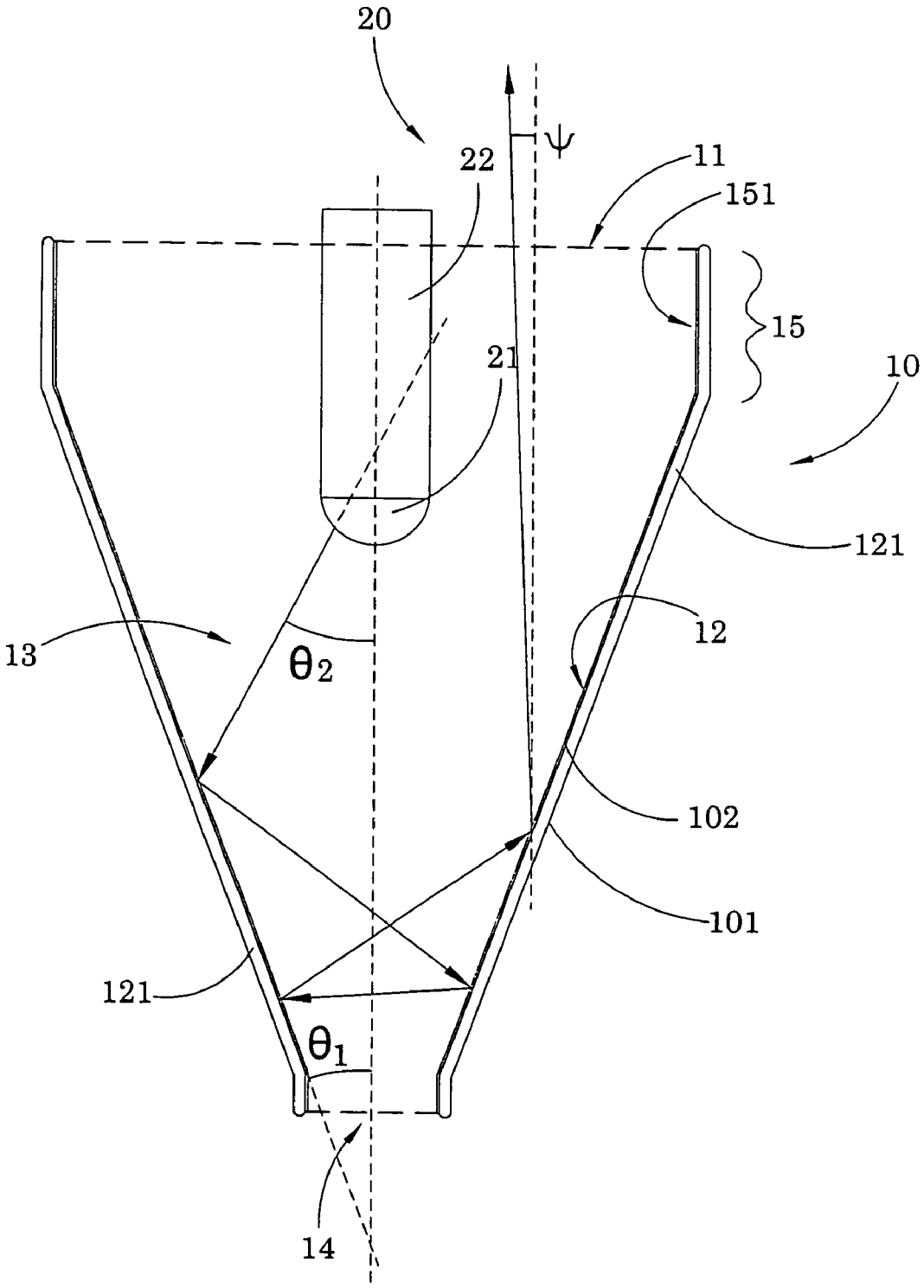
FIG. 5 is a schematic view of the LED lighting apparatus according to the above preferred embodiment of the present invention, illustrating the LED lighting apparatus working in quadruple-reflection mode.

Referring to FIG. 5, in the quadruple-reflection mode, the relationship of the angles is:

$$\Psi=180-8\theta_1-\theta_2$$

When the $\theta_2$ is about 40 degree, the output of the LED will be converted to a narrow angle beam, which is about −5 degree.

The present invention can further be extended to more than quadruple reflection, as the inclining angle $\theta_1$ is reduced. In addition more than one mode can coexist to further increase the efficiency of the LED lighting. For example, the triple-reflection mode and the quadruple-reflection mode can both exist when the proper inclining angle is chosen. The general equation for the present invention about the relationship of the angles is:

$$\Psi=180-2n\theta_1-\theta_2$$

Wherein n represents the number of reflection occurs.

The present invention narrows the light beam angle of the LED, it also regulates the distribution of the LED light output. Referring to the equations for the relationship of the angles, when the inclining angle is fixed, the output angle is changed with the projection angle. Referring to FIGS. 2, 3, and 5, because light rays are not reflected in parallel, some light rays are reflected towards the vertical axis. As a result, there is no black spot in the light beam, and the light will be distributed within the light beam more evenly. Also, because the LED lighting source 20 is not necessary to be assembled on a focal point, it is much convenient for assembly.

Figure 7:
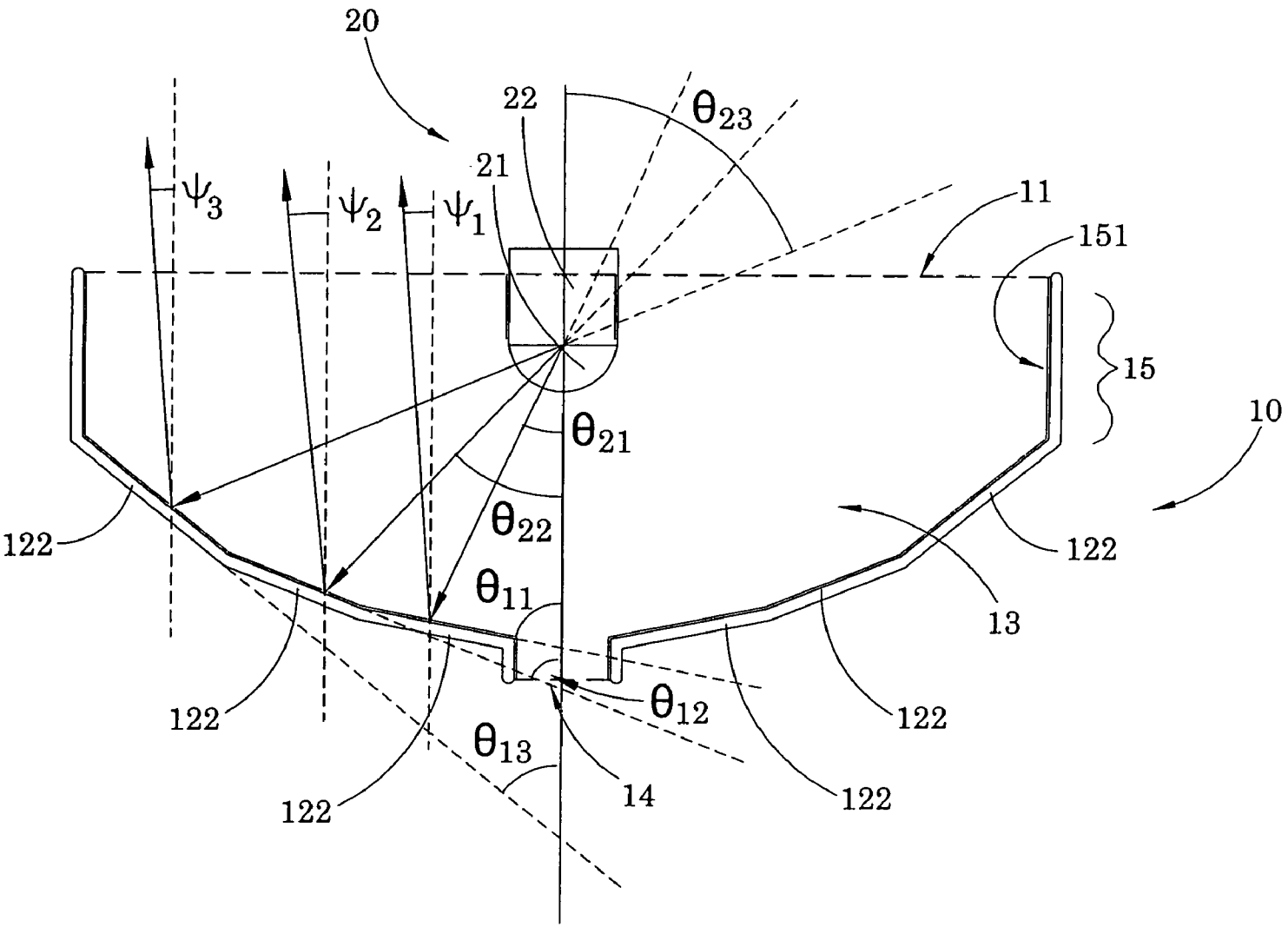
FIG. 7 illustrates an alternative mode of the reflection housing, according to the above preferred embodiment of the present invention, illustrating the linear multi-reflection of the LED lighting apparatus working in single-reflection piecewise linear mode.

Referring to FIG. 7, in an alternative embodiment of the present invention, the reflection surface 12 consists of a plurality of linear sections 122 with discrete inclining angles. Accordingly, the reflection surface 12 contains a plurality of discrete reflective surfaces integrally extended from the vertex of the reflection housing 10 to the light opening 11, wherein the linear sections 122 are defined at the discrete reflective surfaces respectively. Each of said discrete reflective surfaces has a linear slope and defines a corresponding inclination angle for enabling the first portion of the light being single-reflected or multi-reflected within the reflection housing 10.

Figure 6:
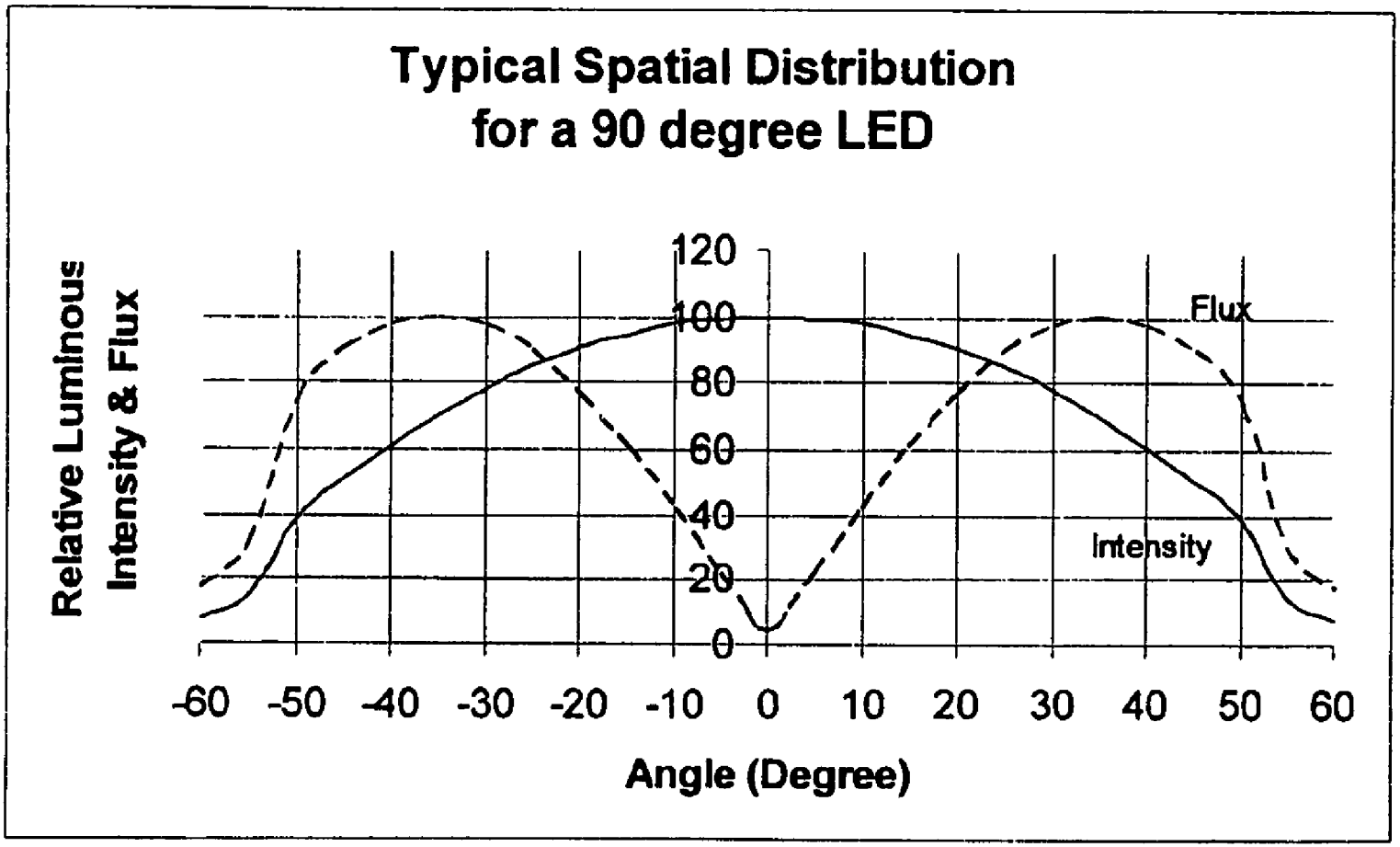
FIG. 6 illustrates a typical relative luminous intensity and relative luminous flux for a 90 degree LED.

Each linear section is a portion of a cone with an inclining angle. These linear sections 122 are connected together to form a reflection housing 10. The linear sections 122 closing to the vertex of the reflection housing 10 have larger inclining angles, and the linear sections 122 closing to the light opening 11 of the reflection housing 10 have smaller inclining angles. Referring to FIG. 6, in one alternative embodiment, the reflection surface 12 consists of 3 linear sections 122 which have 3 inclining angles $\theta_{11}$, $\theta_{12}$, and $\theta_{13}$ respectively. The light rays projected onto the linear sections 122 have the projection angles $\theta_{21}$, $\theta_{22}$, and $\theta_{23}$ respectively. According to the relationship of the angles, the 3 linear sections 122 have 3 output beam angles $\psi_1$, $\psi_2$, and $\psi_3$. With proper inclining angles, and dimensions, each linear section can have a same output beam angle to narrow the output of the LED.

Referring to FIGS. 1 to 5 and 7, the non-reflection arrangement contains a light passing hole 14 formed at the vertex thereof. When light projects on the light passing hole 14, it will pass through and will not be reflected back to the reflection housing 10. If the reflection housing 10 doesn't have the light passing hole 14, the LED light ray along the vertical axis will project on the vertex and will be reflected back along the vertical axis again. This reflected light ray will be blocked by the LED itself and won't pass through. The light will not contribute to the light output by still generate heat.

According to the preferred embodiment, a circumferential size of the light passing hole 14 is at the same as a circumferential size of the light head 21 such that the second portion of the light from the light head 21 can totally project out of the reflection housing 10 through the light passing hole 14. In addition, the circumferential size of the light passing hole 14 is smaller than that of the light opening 11 of the reflection housing 10.

In the present invention, the light along the vertical axis will be released and will not generate heat in the reflection housing 10. In other words, the light head 21 is suspendedly supported within the reflection housing 10 at a position between the vertex and the light opening 11 along at any point of the vertical axis of the reflection housing 10. Therefore, the light passing hole 14 not only allows the second portion of the light directly penetrating through the light passing hole 14 but also releases the heat from the light head 21 out of the reflection housing 10 to prevent the head from being accumulated in the reflection housing 10.

It is worth mentioning, the LED is mounted on the reflection housing 10 by a post. The post provides the mechanical supporting, and a thermal path to work as a heat sink to release heat generated by the LED.

The reflection housing 10 further comprises a tubular reflection rim 15 extended from the light opening 11, wherein the reflection rim 15 has a uniform circular cross section that the circumferential size of the reflection rim 15 matches with the circumferential size of the light opening 11. The reflection rim 15 further has an inner reflective surface 151 extended from the reflection surface 12 of the reflection housing 10 for controlling an output angle of the light at the light opening 11. Accordingly, a height of the reflection rim 15 is smaller than a height of the reflection housing 10 for preventing multi-reflection of the light within the reflection rim 15. Accordingly, the circumferential size of the reflection rim 15 limits the output angle of the light at the light opening 11, wherein the light is preferred to be reflected by the inner reflective surface 151 of the reflection rim 15 in a single-reflection mode.

Figure 9:
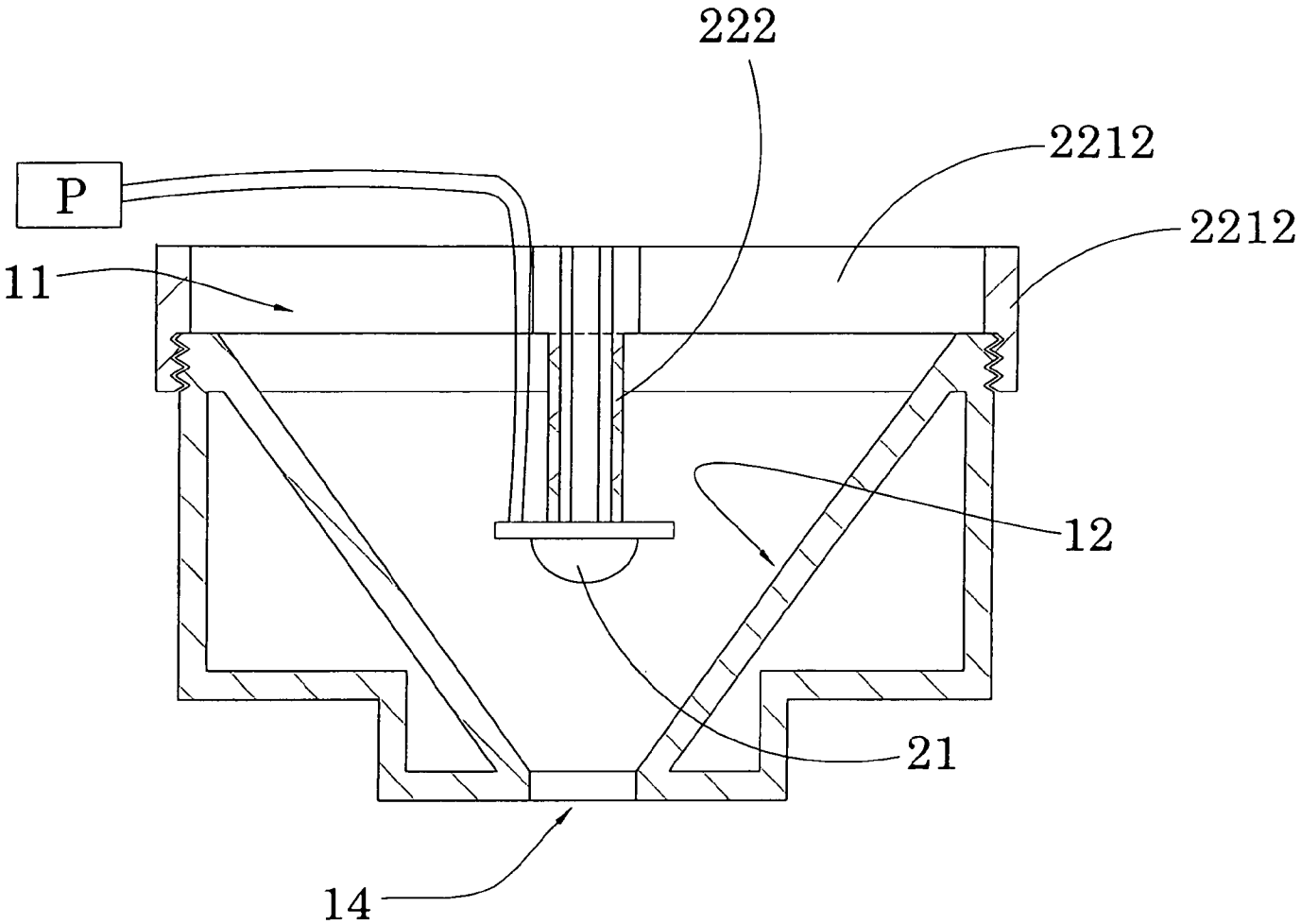
FIG. 9 is an exploded perspective view of the LED lighting apparatus as a spotlight according to the above preferred embodiment of the present invention.

As shown in FIGS. 8 and 9, the light body 22 comprises a light supporting frame 221 coupling with the reflection housing 10 at the light opening 11, and a heat dissipating arm 222 extended from the light supporting frame 221 to support the light head 21 at a free end of the heat dissipating arm 222, such that the heat dissipating arm 222 not only suspendedly supports the light head 21 to align with the vertex of the reflection housing 10 but also effectively dissipates heat generated from the light head 21 to the reflection housing 10.

Accordingly, the light supporting frame 221 comprises a circular coupling ring 2211 detachably coupling with the reflection rim 15 of the reflection housing 10 and a plurality of extending arms 2212 radially extended from the coupling ring 2211 to meet at the vertical axis of the reflection housing 10.

The heat dissipating arm 222, which is preferably made of copper or silver with high heat conduction coefficient, is extended from the extending arms 2212 along the vertical axis of the reflection housing 10. Accordingly, the free end of the heat dissipating arm 222 is extended along the vertical axis of the reflection housing 10 to alignedly point towards the vertex thereof. Therefore, the heat from the light head 21 can be effectively transmitted to the reflection housing 10 through the heat dissipating arm 222. It is worth to mention that the reflection housing 10 has a relatively large surface area for dissipating the heat when the heat is conducted through the heat dissipating arm 222 so as to minimize the heat being accumulated at the light head 21.

Figure 10:
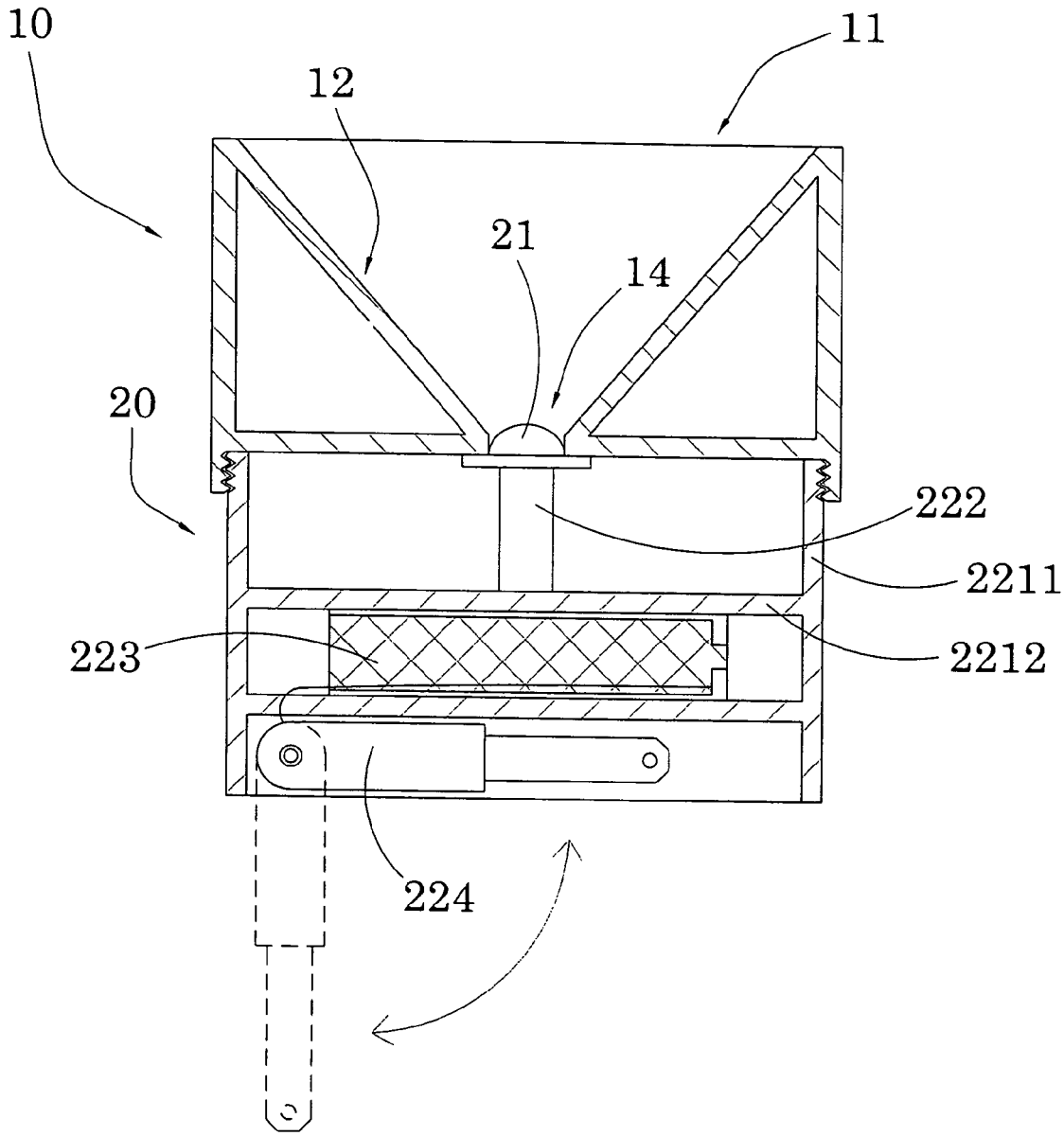
FIG. 10 illustrates the LED lighting apparatus as an illumination device according to the above preferred embodiment of the present invention.

As shown in FIG. 10, the LED lighting apparatus of the present invention forms an illumination device, such as a desk light or a notebook working light. Accordingly, the light head 21 is coaxially coupled at the light passing hole 14 to coaxially pointing towards the light opening 11. In other words, the light head 21 is supported at the vertex of the reflection housing 10 through the light passing hole 14.

In addition, the light head 21 has a light projection angle, i.e. the shootout angle, in a range between 70° and 160°. The reflection housing 10 has an aperture angle in a range between 35° and 95°. In order to form the illumination device, the aperture angle of the reflection housing 10 must be smaller than the light projection angle of the light head 21. Therefore, the light from the light head 21 can be accumulatively reflected at the reflection surface 12 of the reflection housing 10 for enhancing a light intensity of the light before the light is projected out of the reflection housing 10 through the light opening 11.

As shown in FIG. 10 the light supporting frame 221, which is coupling with the reflection housing 10 at the outer side thereof, comprises a circular coupling ring 2211 detachably coupling with the reflection housing 10 and a plurality of extending arms 2212 radially extended from the coupling ring 2211 to meet at the vertical axis of the reflection housing 10.

The heat dissipating arm 222, which is preferably made of copper or silver with high heat conduction coefficient, is extended from the extending arms 2212 along the vertical axis of the reflection housing 10. Accordingly, the free end of the heat dissipating arm 222 is extended along the vertical axis of the reflection housing 10 to alignedly point towards the vertex thereof. Therefore, the heat from the light head 21 can be effectively transmitted to the reflection housing 10 through the heat dissipating arm 222. It is worth to mention that the reflection housing 10 has a relatively large surface area for dissipating the heat when the heat is conducted through the heat dissipating arm 222 so as to minimize the heat being accumulated at the light head 21.

The difference between the spotlight and the illumination device as shown in FIGS. 8 and 9 is the location of the light head 21. The spotlight is constructed that the light head 21 is extended within the reflection housing 10 to point towards the vertex thereof. The illumination device is constructed that the light head 21 is extended at the vertex of the reflection housing 10 to point towards the light opening 11.

Figure 11:
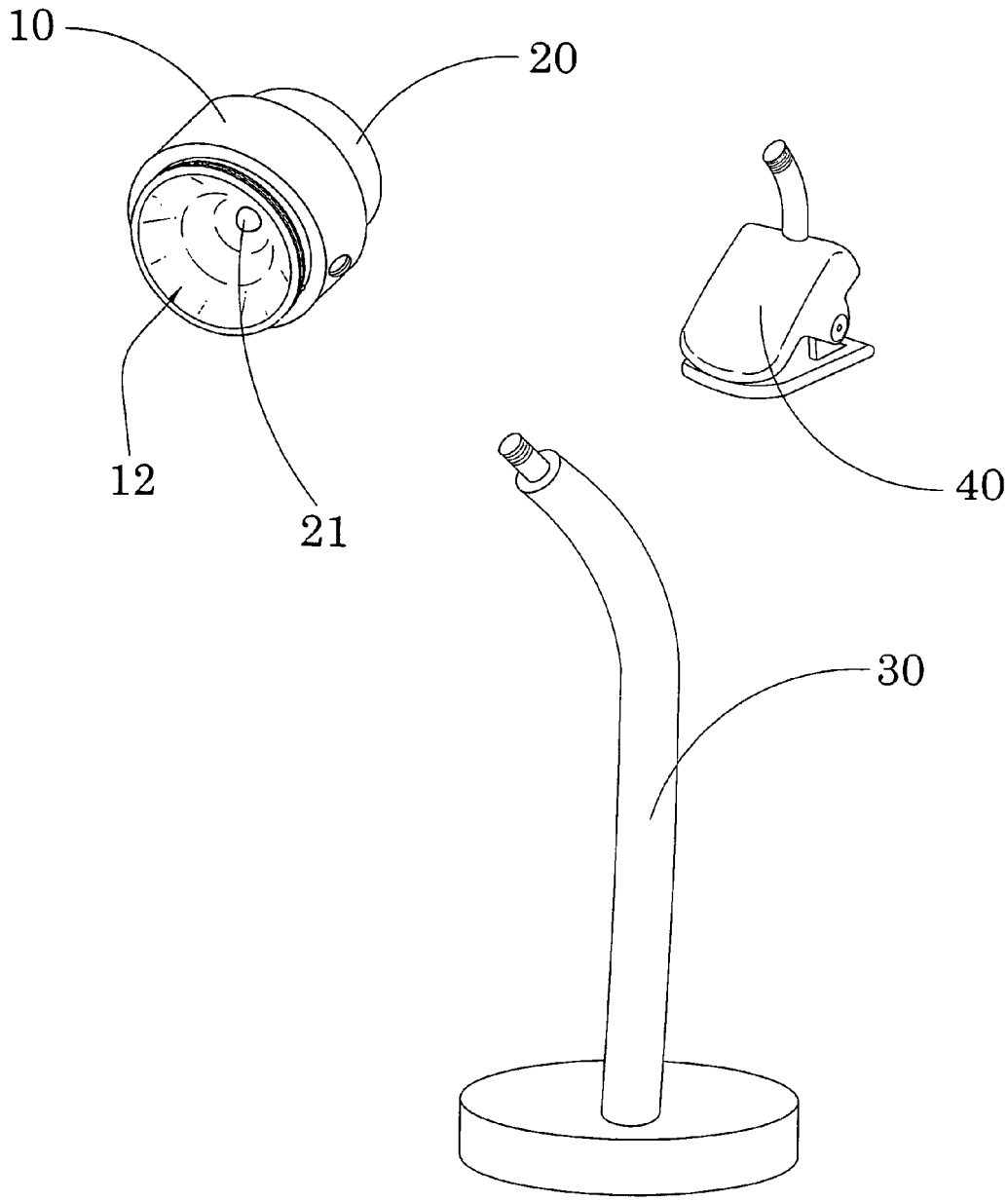
FIG. 11 illustrates the LED lighting apparatus as an illumination device being selectively mounting to a desk light support to from the desk light or at a notebook mount to form the notebook working light according to the above preferred embodiment of the present invention.

As shown in FIG. 10, the light body 22 further comprises a power source 223 supported by the light supporting frame 221 to electrically connect to the light head 21. Preferably, the power source 223 comprises a rechargeable battery adapted for being charged via a power plug 224. Therefore, after the power source 223 is charged, the LED lighting apparatus can be detachably mounted at a desk light support 30 to from the desk light or at a notebook mount 40 to form the notebook working light as shown in FIG. 11.

In summary, the present invention provides an optimized and efficient apparatus for LED types of lighting for flash light, street light, automobile light and special display light applications. Using the linear multiple reflection focusing technique, the wide light pattern is refocused into a narrow beam pattern to improve the lighting efficiency. The distribution of the light output is regulated, and the heat generation is reduced.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A LED lighting apparatus, comprising:

a conical reflection housing having a vertex, a light opening aligning with said vertex, and an inner taper reflection surface extending from said vertex towards said light opening, wherein said reflection housing further comprises a non-reflection arrangement; and a LED light source which comprises a light body coaxially supported by said reflection housing and a light head aligned with said vertex, wherein said non-reflection arrangement is provided at said vertex at a position that said light head is supported within said light housing to alignedly point towards said vertex, such that when said light head generates light towards said reflection surface of said reflection housing, a first portion of said light is accumulatively reflected by said reflection surface of said reflection housing towards said light opening while a second portion of said light is projected towards said non-reflection arrangement so as to prevent said second portion of said light being reflected back to said light source for minimizing a black spot occurring at said light opening, wherein said non-reflection arrangement further contains a light passing hole formed at said vertex of said reflection housing to coaxially align with said light head such that said second portion of said light directly penetrates out of said reflection housing through said light passing hole for preventing said second portion of said light being reflected at said vertex of said reflection housing, and wherein when said light head generates light within said reflection housing, said light is accumulatively reflected at said reflection surface of said reflection housing for enhancing a light intensity of said light before said light is projected out of said reflection housing through said light opening, wherein said light body comprises a light supporting frame coupling with said reflection housing at said light opening, and a heat dissipating arm extended from said light supporting frame to support said light head at a free end of said heat dissipating arm, such that said heat dissipating arm not only suspendedly supports said light head to align with said vertex of said reflection housing but also effectively dissipates heat generated from said light head to said reflection housing.

2. The LED lighting apparatus, as recited in claim 1, wherein a circumferential size of said light passing hole is at the same as a circumferential size of said light head and is smaller than a circumferential size of said light opening of said reflection housing.

3. The LED lighting apparatus, as recited in claim 2, wherein said reflection surface, having a linear slope and defining an inclination angle, extends from said vertex of said reflection housing to said light opening for enabling said first portion of said light being multi-reflected within said reflection housing.

4. The LED lighting apparatus, as recited in claim 2, further comprising a tubular reflection rim extended from said light opening, wherein said reflection rim has a circumferential size matching with a circumferential size of said light opening and an inner reflective surface extended from said reflection surface of said reflection housing for controlling an output angle of said light at said light opening.

5. The LED lighting apparatus, as recited in claim 4, wherein a height of said reflection rim is smaller than a height of said reflection housing for preventing multi-reflection of said light within said reflection rim.

6. The LED lighting apparatus, as recited in claim 5, wherein said reflection surface contains a plurality of discrete reflective surfaces integrally extended from said vertex of said reflection housing to said light opening, wherein each of said discrete reflective surfaces has a linear slope and defines a corresponding inclination angle for enabling said first portion of said light being multi-reflected within said reflection housing.

7. The LED lighting apparatus, as recited in claim 5, wherein said reflection surface, having a linear slope and defining an inclination angle, extends from said vertex of said reflection housing to said light opening for enabling said first portion of said light being multi-reflected within said reflection housing.

8. The LED lighting apparatus, as recited in claim 7, wherein said reflection surface contains a plurality of discrete reflective surfaces integrally extended from said vertex of said reflection housing to said light opening, wherein each of said discrete reflective surfaces has a linear slope and defines a corresponding inclination angle for enabling said first portion of said light being multi-reflected within said reflection housing.

9. The LED lighting apparatus, as recited in claim 4, wherein said reflection surface, having a linear slope and defining an inclination angle, extends from said vertex of said reflection housing to said light opening for enabling said first portion of said light being multi-reflected within said reflection housing.

10. The LED lighting apparatus, as recited in claim 4, wherein said reflection surface contains a plurality of discrete reflective surfaces integrally extended from said vertex of said reflection housing to said light opening, wherein each of said discrete reflective surfaces has a linear slope and defines a corresponding inclination angle for enabling said first portion of said light being multi-reflected within said reflection housing.

11. The LED lighting apparatus, as recited in claim 1, further comprising a tubular reflection rim extended from said light opening, wherein said reflection rim has a circumferential size matching with a circumferential size of said light opening and an inner reflective surface extended from said reflection surface of said reflection housing for controlling an output angle of said light at said light opening.

12. The LED lighting apparatus, as recited in claim 11, wherein a height of said reflection rim is smaller than a height of said reflection housing for preventing multi-reflection of said light within said reflection rim.

13. The LED lighting apparatus, as recited in claim 12, wherein said reflection surface contains a plurality of discrete reflective surfaces integrally extended from said vertex of said reflection housing to said light opening, wherein each of said discrete reflective surfaces has a linear slope and defines a corresponding inclination angle for enabling said light being multi-reflected within said reflection housing.

* * * * *